United States Patent [19]

Orlando

[11] Patent Number: 4,791,757

[45] Date of Patent: Dec. 20, 1988

[54] ROLLER GATE OPENER

[76] Inventor: Paul F. Orlando, 1811 Kanola Rd., La Habra Heights, Calif. 90631

[21] Appl. No.: 71,758

[22] Filed: Jul. 9, 1987

[51] Int. Cl.[4] ..... E05F 11/00

[52] U.S. Cl. ..... 49/360

[58] Field of Search ..... 49/360, 361, 362, 363

[56] References Cited

U.S. PATENT DOCUMENTS

| | | | |
|---|---|---|---|
| 935,206 | 9/1909 | Holdeman . | |
| 1,324,587 | 12/1919 | Elliott . | |
| 2,346,388 | 4/1944 | Peebles . | |
| 3,257,756 | 6/1966 | Mealer . | |
| 3,606,699 | 9/1971 | Robinson, Jr. . | |
| 3,762,524 | 10/1973 | Anderson . | |
| 3,775,906 | 12/1973 | Dougherty . | |
| 3,797,171 | 3/1974 | Farmer | 49/360 |
| 3,988,860 | 11/1976 | Nevarez . | |
| 4,313,281 | 2/1982 | Richmond . | |
| 4,366,649 | 1/1983 | Weigant | 49/362 |
| 4,475,312 | 10/1984 | Deutschle | 49/360 |
| 4,495,730 | 1/1985 | Kennedy . | |
| 4,520,592 | 6/1985 | Holloway . | |

OTHER PUBLICATIONS

Sears Garage Door Opener Owners Manual; Model 139.663953; 23 pages.

*Primary Examiner*—Philip C. Kannan

*Attorney, Agent, or Firm*—Knobbe, Martens, Olson, Bear

[57] ABSTRACT

A garage door opener is mounted on a fence to move a roller gate horizontally across a fence opening. A trolley connected to the gate slides on a horizontal guide which is mounted on the fence, extending between the fence and the gate in its open position.

15 Claims, 2 Drawing Sheets

10
11a
11b
11c
11d
12
14
14a
14b
16
18
19a
19b
20a
20b
28
34
70

10
11d
14
14b
18
19a
19b
20a
20b
22
34
36
38
40
46
48
56
68
3

11d
14b
19b
20b
22
41a
41b
46
48
56
58
60
62
64
68

11d
34a
34b
36
38
46
48
68a
68b

ROLLER GATE OPENER

BACKGROUND OF THE INVENTION

The present invention relates to apparatus for opening and closing a gate or other such closure of the type which slides or rolls edgewise across a opening in a fence or building.

Automatic gate openers are very convenient, particularly if the gate extends across a driveway or a garage opening such that the gate or other closure can be moved by a vehicle operator without the operator having to get out of the vehicle. Also, since some closures are quite heavy, it is physically difficult for some people to manually move the closure.

In spite of this convenience, gate openers for such closures have been primarily utilized in commercial or industrial facilities or in multi-family dwellings, such as apartments or condominiums. Usage in single family homes has been rather limited. It is believed that a primary reason for this relates to the cost of most closure openers of this type. For example, often the motor or other drive means in a gate opener is mounted in a below-ground or below-floor level arrangement. This adds greatly to the expense of installation, requiring special skill and equipment that home owners usually do not have. Other known systems involve other complex mounting arrangements.

By contrast, garage door openers used for doors that swing upwardly into a horizontal position have attained widespread usage and are, in general, much less expensive than gate openers. Further, the equipment is relatively easy to install such that many home owners do it themselves. Thus, it is believed that a need exists for an improved apparatus for opening or closing a roller gate or other such closure that is inexpensive and easy to install.

SUMMARY OF THE INVENTION

Briefly stated, a known overhead garage door opener is combined with specialized mounting hardware to enable the opener to be utilized for opening and closing a vertical gate or other such closure which slides or rolls edgewise across an opening in a building, fence or other such structure. More specifically, the motor is mounted to such structure at a location horizontally spaced from the opening so that the closure can be fully opened without reaching the motor. An elongated guide extends from the motor to the edge of the gate opening. A drive element such as a chain cable combination extends in a loop around the guide. At one end, the loop is in driven engagement with a motor driven gear, the other end of the loop being supported by a pulley supported on an end bracket. A trolley which is slidably mounted on the guide is connected to the edge of the closure so that the trolley, and hence the closure, is moved by the motor between open and closed positions with respect to the opening. The connection from the pulley to the edge of the closure is made in a manner to accommodate some vertical movement of the closure relative to the elongated guide. Thus, irregularities in the mounting or rolling support arrangement of the closure can be accommodated without producing binding between the pulley and the closure.

A preferred form of the connection includes a connector link that is slidably mounted on a pin vertically supported on the edge of the closure, with springs on the pin on each side of the connector link allowing the desired relative movement while urging the link to be centered on the pin.

The guide for the trolley in the preferred contruction has a T-shaped cross-section and is oriented on its side so that the head section of the T-shape is vertical, with the horizontal leg of the T-shape extending between the fence and the head section. A cover having an angled cross-section extends over the T-shaped guide to protect and restrict access to the trolley and the drive element. The vertical leg of the cover extends between the fence and the elongated guide to shield the guide in that area. A plurality of spaced supports secured to the cover extend beneath the T-shaped guide and beneath the drive element to provide slidable support for the lower section of the guide element.

PREFERRED EMBODIMENT OF THE INVENTION

Figure 1:
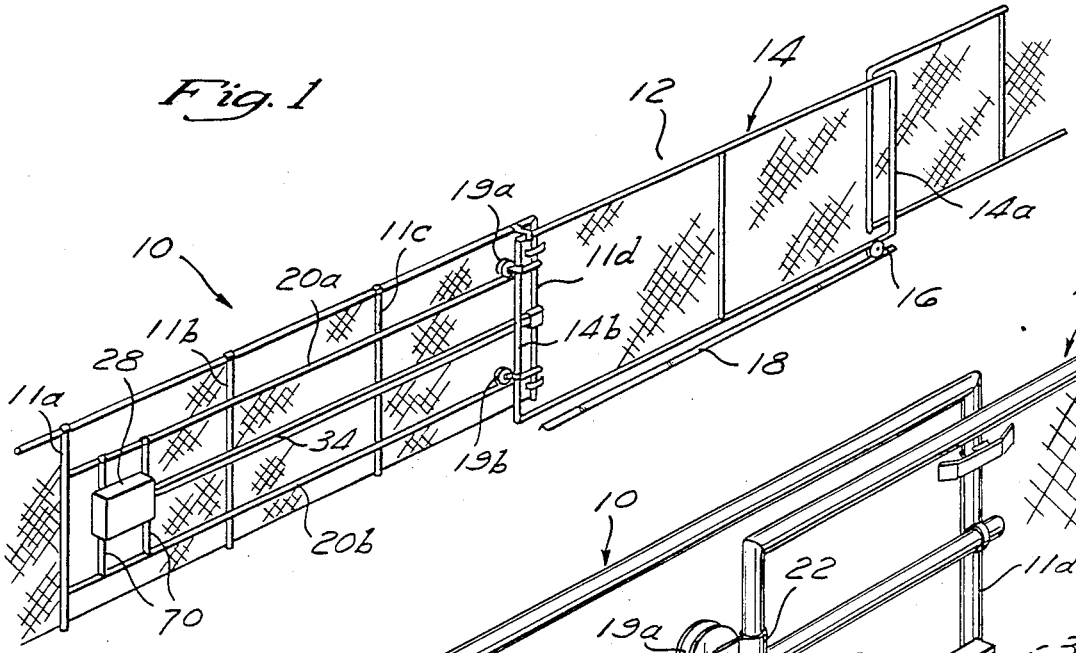
FIG. 1 is a perspective view of a fence together with the apparatus of the invention used to open and close a gate.

Referring to FIG. 1, there is shown a fence 10 having an opening 12 therein with a large planar gate or closure 14 which is shown extending across the opening 12. A wheel 16 rotatably supported on the end 14*a* of the gate which moves across the gate opening supporting that end of the gate while rolling on a V-shaped track 18 positioned beneath the gate with the V-shaped edge of the rail extending upwardly. The other end 14*b* of the gate is supported by rollers 19 which ride on a pair of elongated rails 20 formed by pipes that span the distance between four vertically oriented, horizontally spaced posts 11 in the fence 10. The tubular rails 20 are supported by the end posts 11*a* and 11*d*, and may also be supported or secured to the two middle posts 11*b* and 11*c*, if desired.

Figure 2:
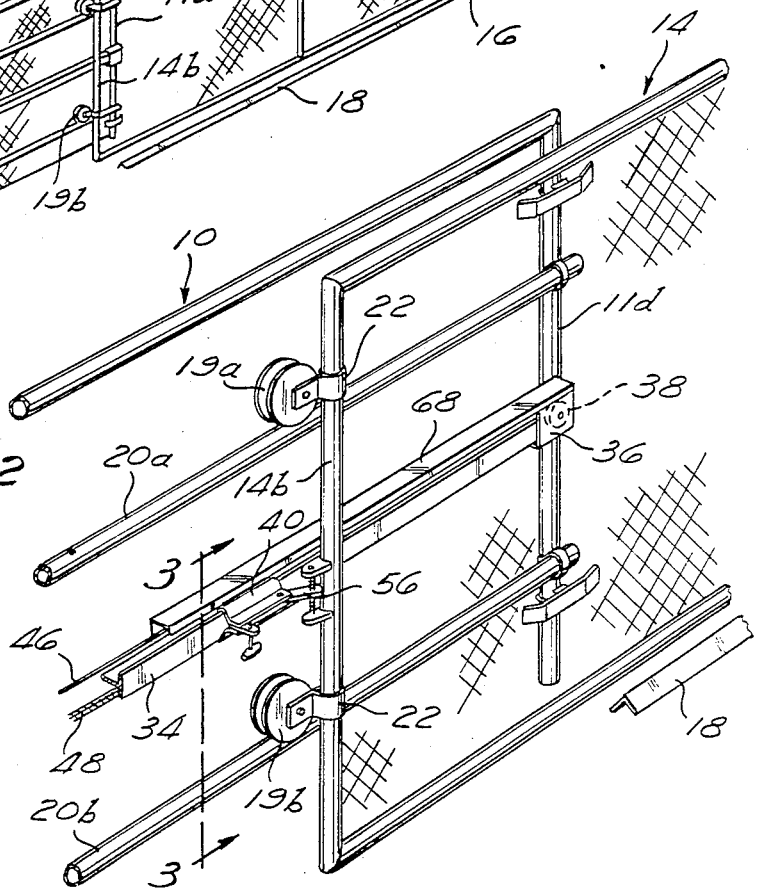
FIG. 2 is an enlarged perspective view of one end of the gate and the adjacent fence.
Figure 3:
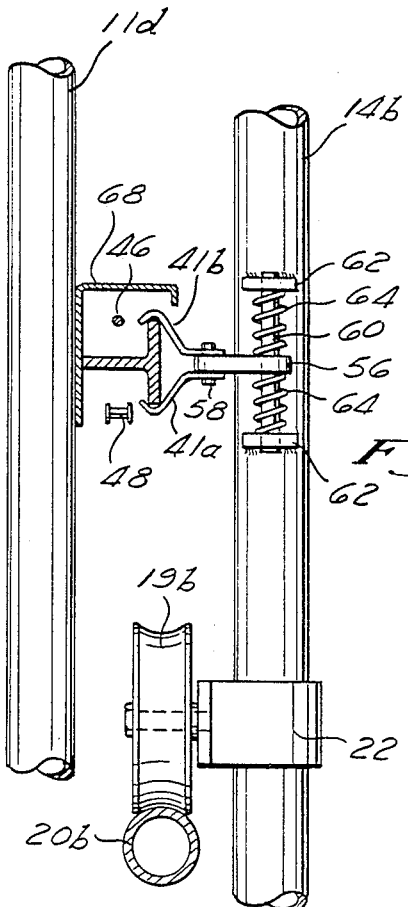
FIG. 3 is a cross-sectional view on line 3—3 of FIG. 2 illustrating in greater detail the connection between the gate and the gate moving mechanism.
Figure 4:
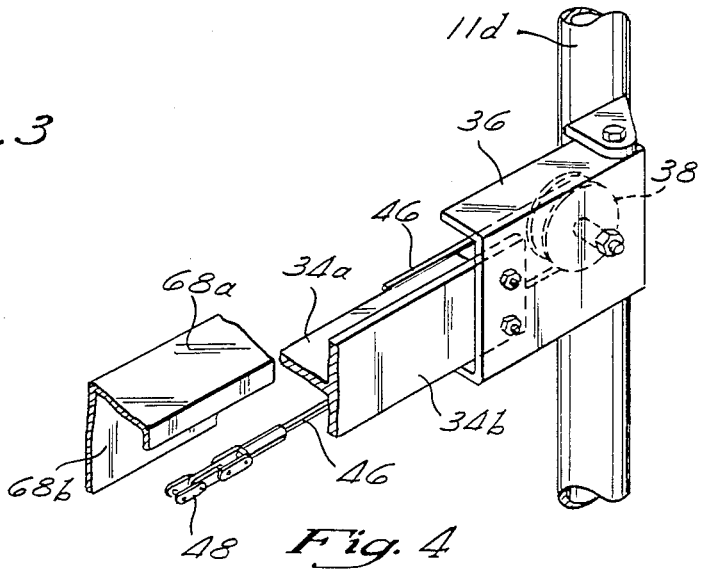
FIG. 4 is an enlarged perspective view showing the pulley end of the guide for the drive element.

Referring to FIG. 2, it may be seen more clearly that the rollers 19 are each connected by a bracket 22 to the end post 14*b* of the gate 14. The upper roller 19*a* rides on the upper rail 20*a* while the lower roller 19*b* rides on the lower rail 20*b*. With this arrangement, the gate 14 can be conveniently rolled between open and closed positions. The gate and its roller mounting arrangement is a conventional construction and is to be merely considered as exemplary of other mounting arrangements that can be employed.

Figure 5:
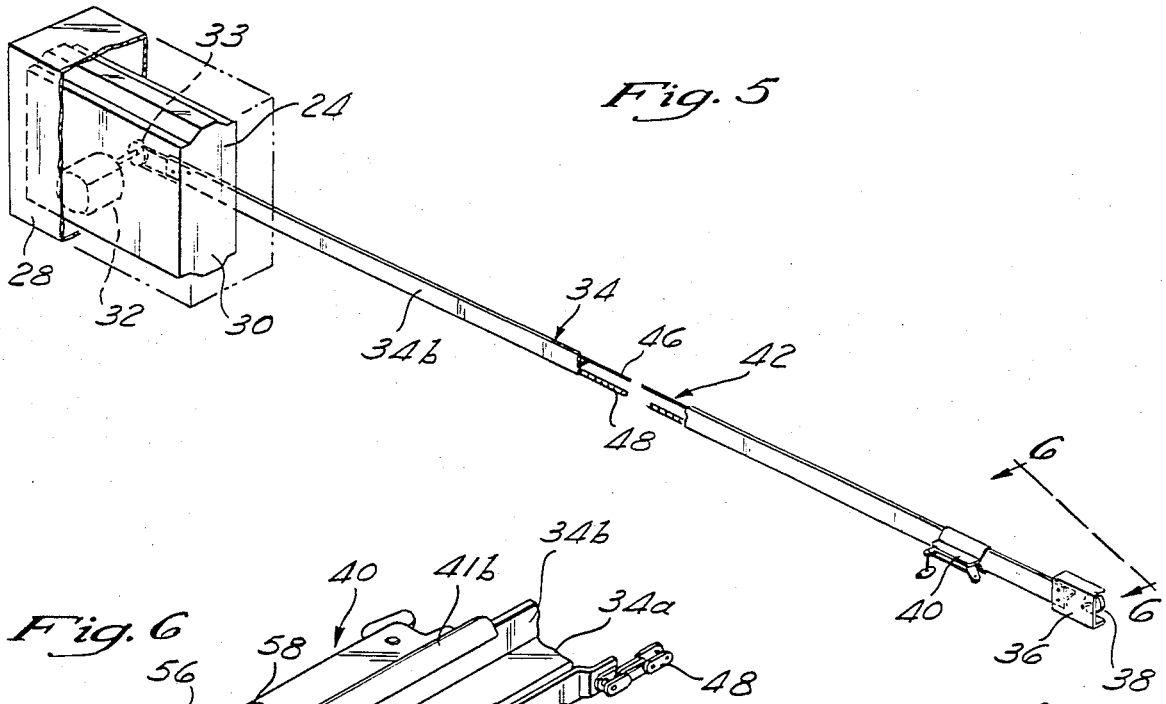
FIG. 5 is a perspective view of the gate opening apparatus by itself.
Figure 6:
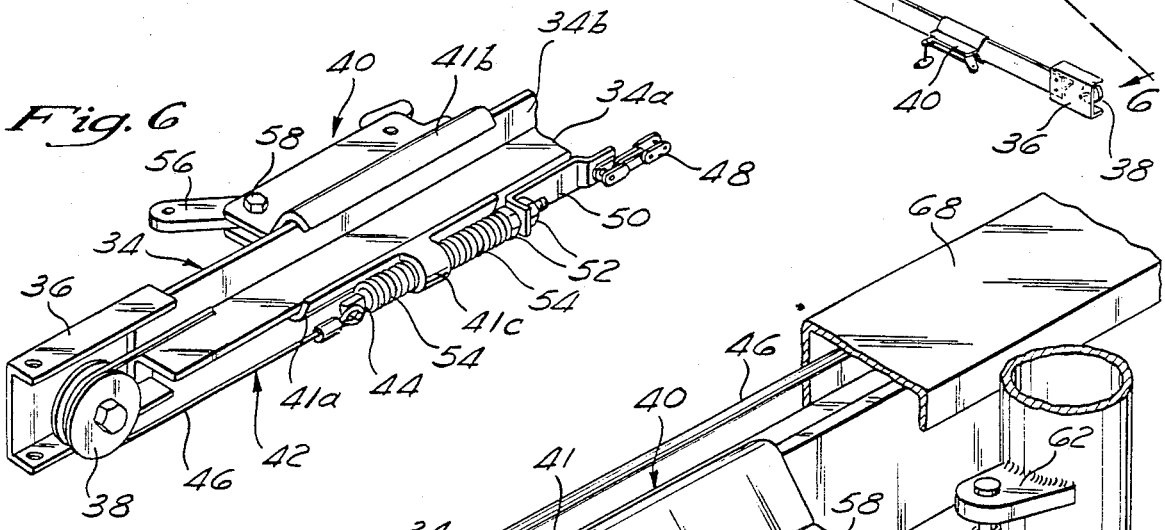
FIG. 6 is a perspective view on line 6—6 of FIG. 5 illustrating the pulley end of the guide and also illustrating the connection between the drive element cable and the drive element chain.

In accordance with the invention, an automatic opener 24 is mounted on the fence 10 and connected to the gate 14 in a manner to enable the gate to be rolled opened or closed by the opener. A kit of special mounting fittings and hardware are provided for mounting the opener on the fence and suitably connecting it to the gate. The known opener 24 is essentially as shown in FIG. 5 except for a protective cover or housing 28 extending over the motor chassis 30. Thus, the opener 24 includes an electric drive motor 32 mounted in the chassis 30. An elongated guide 34 is secured at one end to the chassis 30 and secured at the other end to a pulley bracket 36. The guide 34 has a T-shaped cross-section, with the leg 34*a* of the cross-section extending horizontally as shown in FIG. 5 and the head section 34*b* extending vertically adjacent to the opener chassis 30. A trolley assembly 40 is slidably mounted on the guide 34 and driven by a drive element 42 that extends in a loop from a pulley gear 33 connected to the output shaft of the motor 32 and at pulley 38 rotatably mounted on the pulley bracket 36. The trolley 40 includes a pair of jaws 41 that enclose the vertical ends of the head section 34*b* of the guide 34. The lower jaw 41*a* includes a central portion 41c which receives and guides a trolley shaft 44 that extends on the lower side of the guide leg 34*a*, as oriented in the drawings. The drive element 42 includes a cable 46 serially connected to a chain 48. One end of the cable is secured by suitable means to the end of the trolley shaft closest to the pulley 38. One end of the chain 48 is connected to a chain retainer 50, with the other end of the retainer being slidably mounted on the trolley pin 44 and secured to the pin in an adjustable manner by a pair of nuts 52 threaded onto the pin. A pair of centering springs 54 positioned on opposite sides of the central mounting portion 41*c* of the jaw 41*a* provide a resilient connection to cushion initial motion of the trolley in either direction, thus providing smoother initial and ending motion, and reducing shock loads on the motor. As will be apparent, operation of the motor drives the chain portion of the driving element 42 which in turn likewise moves the cable and slides the trolley assembly 40 on the guide 34. Further details of the opener and its controls which are not disclosed herein may be found in the garage door opener owner's manual provided with the opener model 139.663953 sold by the well-known Sears chain of stores.

The trolley assembly 40 is connected to the gate 14 by a flat connector or link 56 which has one end pivotally connected to the trolley assembly by means of a bolt 58 vertically oriented and extending through a hole in the jaws 41, while the other end of the link is pivotally mounted on a pin 60 which is likewise vertically oriented. The pin is spaced from the gate end post 14*b* and mounted by a pair of vertically spaced lugs 62 which are welded or secured by suitable brackets (not shown) to the end post 14*b*. A pair of springs 64 are mounted on the pin with one spring extending between the link 56 and the upper lug and the other spring extending between the link and the lower lug. With this slidable spring biased arrangement, vertical movement of the gate relative to the guide 34 is accommodated. The springs tend to center the link on the pin as permitted by the position of the gate. While it is intended that there not be vertical movement of the gate relative to the guide 34, the apparatus is not composed of precision components such that some movement is anticipated, particularly in view of the extended width of the gate. Also, dirt, ice or debris may cause the roller 16 on the gate to move the gate up and down a small amount as the gate is being opened or closed. The unique connecting arrangement between the trolley and the gate can readily accommodate vertical movement of the gate relative to the fence. Also, the pivoting link allows horizontal variation in the spacing between the gate and the fence as the gate is being moved.

To shield the drive element 42 and the upper side of the guide 34 from rain, snow and dirt to some extent, there is provided an elongated cover 68 which partially encloses the guide 34. The cover has an angled cross-section including a horizontally extending upper leg 68*a* which extends over the guide 34 and a vertical leg 68*b* which extends between the guide and the fence. The cover also provides a safety element by minimizing access to the drive element so as to minimize tampering. This is important because it prevents binding and enables the use of a relatively low-cost motor.

Figure 7:
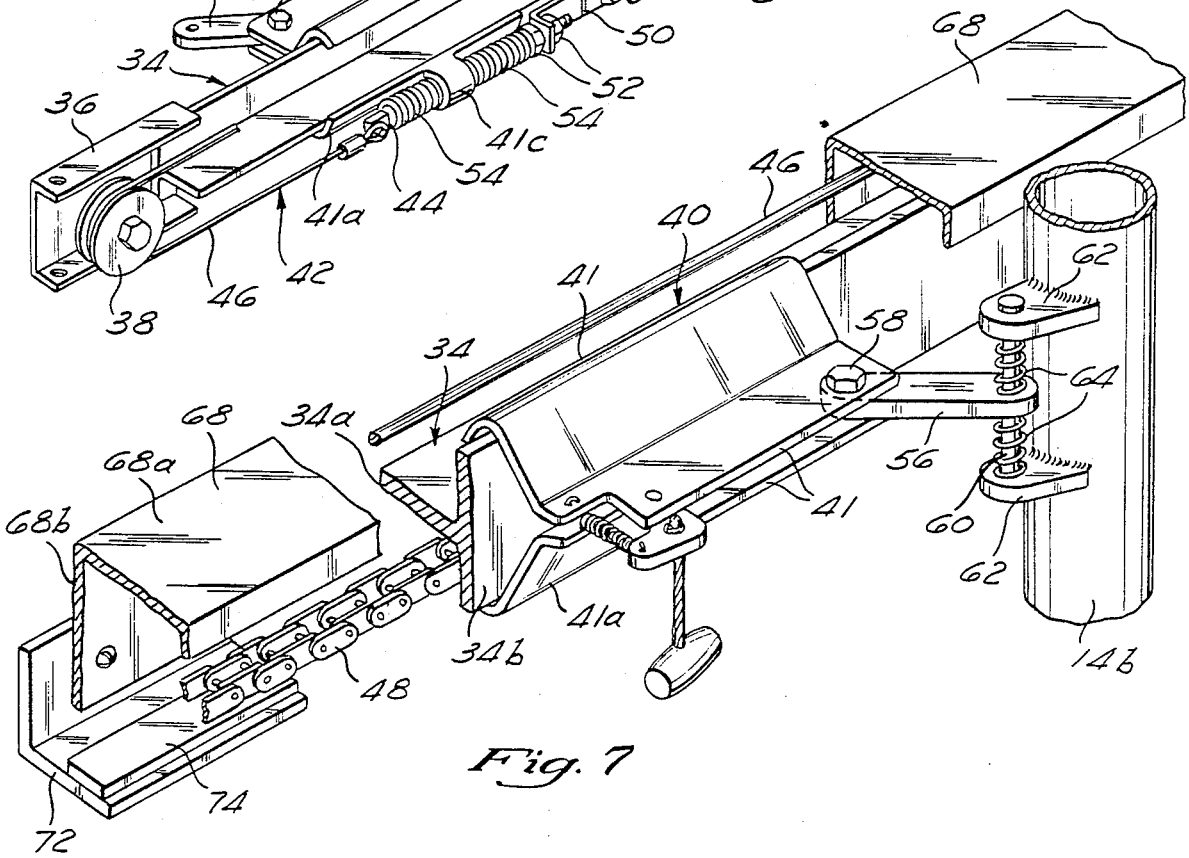
FIG. 7 is an enlarged perspective view of the connection between the trolley and the edge of the gate.

As may be seen, the upper portion of the drive element 42 rides or slides on the horizontal leg of the T-shaped guide, while the lower portion hangs downwardly to the extent permitted, consistent with the tension on the drive element. To prevent it from hanging too low and to minimize tension on the drive element, there is provided a plurality of support members 72 that extend horizontally from the lower edge of the cover beneath the lower segment of the drive element, as best seen in FIG. 7. To minimize friction, there is preferably provided a layer of Teflon 74 or other such material to be engaged by the drive element.

To provide further security and weatherproofing, the housing 28 encloses the opener chassis 30 and is mounted to a pair of vertically oriented spaced struts 70 which are secured to the horizontally extending rails 20. The housing is advantageously mounted upon ground level to be protected from water or snow and so as not to interfere with lawn mowing, etc. If desired, a keyed locking arrangement may be provided to control access through the housing to the opener chassis.

The gate opening and closing apparatus is relatively inexpensive inasmuch as a conventional low-cost garage door opener provides the primary component of the system and of the special fitting and connecting components are likewise relatively inexpensive. The apparatus may be assembled and mounted by a typical home owner employing tools a home owner normally has.

I claim:

1. Apparatus for opening and closing a generally planar gate or other such closure of the type which slides or rolls edgewise across an opening in a building, fence, or other such structure, said apparatus comprising:

a motor including a surrounding housing;

means for mounting said motor housing on said structure at a location horizontally spaced from said opening slightly greater than the horizontal length of said closure so that said closure can be fully opened without reaching said housing;

an elongated guide having one end fixed to said housing;

a bracket for fixing the other end of the guide to said structure adjacent to said opening so that the guide when so mounted extends horizontally on said structure, said guide having a profile such that it can extend between said structure and the closure when the closure is in open position;

a pulley rotatably mounted on said bracket;

a trolley slidably mounted on said guide;

a drive element secured to said trolley and extending in a loop on said guide from said motor and said pulley with said element being in driven relation with said motor so that said trolley can be moved horizontally along said guide in closure opening or closing directions; and connector means for connecting said trolley to an end of said closure in a manner to accommodate relative vertical movement between the moving closure and the fixed guide as said closure is rolled horizontally by said trolley.

2. The apparatus of claim 1, wherein said connector means comprises a pin to be vertically mounted on an end edge of said closure, and a link which is slidably mounted on said pin for vertical movement.

3. The apparatus of claim 2, including spring means mounted on said pin urging said connector into vertically centered relation on said pin.

4. The apparatus of claim 3, wherein said link is pivotally connected to said trolley and pivotally connected to said pin.

5. The apparatus of claim 1, wherein said connector means includes a link pivotally connected to said trolley and means for pivotally connecting the link to said closure.

6. The apparatus of claim 1, including an elongated cover to extend horizontally from said motor housing to enclose said guide and said drive element.

7. The apparatus of claim 6, including a plurality of support members extending beneath said drive element to provide support for said guide.

8. The apparatus of claim 1, wherein said guide has a T-shaped cross-section and is adapted to be supported with the head of said T-shaped cross-section extending vertically and with the leg of the T-shaped cross-section extending horizontally from the head towards said structure, said trolley being slidably mounted on said head section with said drive element extending in a loo around the horizontal leg of said guide.

9. The apparatus of claim 8, including an elongated cover having an angled cross-section to be mounted with a horizontal leg extending over said guide and a vertical leg to extend between said guide horizontal leg and said structure.

10. The apparatus of claim 9, including a plurality of support members extending horizontally from the lower edge of said cover vertical leg to extend beneath the lower portion of said drive element and provide support for said guide.

11. The apparatus, comprising:

a structure such as a building or fence having an opening therein;

a generally planar closure such as a door or gate;

means for supporting said closure for sliding or rolling edgewise movement of said closure across said opening; and an assembly for moving said closure in opening and closing positions across said opening, said assembly including:

a motor mounted on said structure at a location horizontally spaced from said opening slightly greater than the horizontal length of said closure so that said closure can be fully opened without reaching said motor;

an elongated guide mounted on said structure and extending horizontally between said motor and one edge of said opening, said guide being sized such that it extends between said structure and the closure when the closure is in an open position;

a trolley slidably mounted onto said guide;

a connector connecting said trolley and said closure in a manner to cause the closure to be pushed or pulled horizontally while accommodating relative vertical movement between the closure and said guide;

an elongated drive element connected in driven relation to said motor and extending in a loop around said elongated guide so that the element can be driven in either direction and is slidably supported by said guide, said element being connected to said trolley so that said closure can be moved horizontally in opening and closing directions with respect to said opening.

12. The apparatus of claim 11, including:

a pair of horizontally extending rails mounted on said structure;

roller means mounted on the edge of said closure and rollingly engaging said rails to support and guide movement of said closure in opening and closing movement across said opening; and means secured to said rails and supporting said motor.

13. The apparatus of claim 12, wherein said guide has a T-shaped cross-section, the head of said T-shaped cross-section is vertically oriented with the horizontal leg of said T-shaped cross-section extending between said head section and said structure, and said trolley is slidably mounted on said vertically oriented head section.

14. The apparatus of claim 11, wherein said connector means includes a pin vertically mounted on the edge of said closure by lugs attached to the closure, said pin being spaced from the closure, a link which is slidably mounted on said pin, and spring means extending between said connector link and said lugs to center said link on said pin.

15. The apparatus of claim 14, wherein said link is connected for horizontal pivotal movement with respect to said trolley and with respect to said pin.

* * * * *